US005370050A

United States Patent [19]

Reffert

[11] Patent Number: 5,370,050

[45] Date of Patent: Dec. 6, 1994

[54] PRINTING CYLINDER AND ENDLESS SLEEVE

[75] Inventor: Roland Reffert, Frankenthal, Germany

[73] Assignee: Albert-Frankenthal Aktiengesellschaft, Wurzburg, Germany

[21] Appl. No.: 49,356

[22] Filed: Apr. 21, 1993

[30] Foreign Application Priority Data

Apr. 21, 1992 [DE] Germany ..... 4213012

[51] Int. Cl.[5] ..... B41F 27/06

[52] U.S. Cl. ..... 101/389.1; 101/401.1; 101/463.1; 101/375

[58] Field of Search ..... 101/389.1, 375, 463.1, 101/467, 401.1, 376, 453

[56] References Cited

U.S. PATENT DOCUMENTS

| | | | |
|---|---|---|---|
| 3,263,606 | 8/1966 | Poynter | 101/179 |
| 3,745,626 | 7/1973 | Bray | 101/389.1 |
| 3,810,055 | 5/1974 | Wright | 101/389.1 |
| 4,812,219 | 3/1989 | Sattrup et al. | 101/375 |
| 4,817,527 | 4/1989 | Wouch et al. | 101/389.1 |

FOREIGN PATENT DOCUMENTS

| | | |
|---|---|---|
| 602602 | 8/1927 | France . |
| 1760330 | 5/1967 | Germany . |
| 2231452 | 6/1972 | Germany . |
| 8122637 | 8/1981 | Germany . |
| 7807348 | 1/1980 | Netherlands . |

OTHER PUBLICATIONS

"The Case for Magnetic Plate Cylinders", Tom Curro; Package Printing & Flexography, Apr. 1974 pp. 16 & 37–43.

*Primary Examiner*—Edgar S. Burr
*Assistant Examiner*—Lynn D. Hendrickson
*Attorney, Agent, or Firm*—Jones, Tullar & Cooper

[57] ABSTRACT

A printing cylinder utilizes a magnetic surface to support a portion of a ferro-magnetic endless printing sleeve which has a circumferential length greater than that of the printing cylinder on which it is supported. A sleeve tightening assembly supports that part of the endless sleeve which is not in contact with the periphery of the printing cylinder.

12 Claims, 4 Drawing Sheets

PRINTING CYLINDER AND ENDLESS SLEEVE

FIELD OF THE INVENTION

The present invention is directed generally to a printing cylinder and endless sleeve for a web-fed rotary printing press. More particularly, the present invention is directed to a magnetic printing cylinder and an endless sleeve for a printing press. Most specifically, the present invention is directed to a magnetic printing cylinder and an endless sleeve having a ferro-magnetic material. The endless sleeve has an inner circumferential length which is greater than the outer circumferential length of the magnetic printing cylinder. The endless sleeve thus is in contact with the magnetic printing cylinder over only a portion of the cylinder's surface. A suitable sleeve tightening assembly is interposed in the space between the magnetic printing cylinder and the inner surface of the sleeve. A sleeve tensioning assembly may also be situated exteriorly of the sleeve.

DESCRIPTION OF THE PRIOR ART

It is known generally in the art to utilize an endless sleeve as a printing plate or printing surface. In one prior art device, as shown in German document No. DE 81 22 637 A1 there is shown a web-fed rotary printing press which utilizes an endless printing tape that carries print images. In this prior art document it is discussed that it is necessary to obtain a high quality print and that it is thus necessary to provide the endless printing tape with transporting perforations. These perforations on the endless printing tape are engaged by drive pins on the printing tape cylinder.

One limitation of the prior art device is that the quality of the printed product, which is provided by the endless printing tape carried by the printing tape cylinder, depends on the accuracy of the positioning of the drive pins around the circumference of the printing tape cylinder and on the accuracy of the spacings or distances between the perforations formed in the endless printing tape. If either the pin placement or the perforation spacing is inaccurate, the endless printing tape will not be accurately carried by the printing tape cylinder. These inaccuracies will, in turn, give rise to register errors that will reduce the quality of the printed product.

Another prior art device is shown in German document No. DE 22 31 451 A1. This publication discloses a magnetic forme cylinder which receives flexible printing plates of definite lengths. These flexible printing plates include a ferro-magnetic material.

A need exists for a printing cylinder and endless sleeve assembly in a web-fed rotary printing press which will overcome the limitations of the prior art devices. The printing cylinder and endless sleeve in accordance with the present invention provides such a device and is a significant improvement over the prior art devices.

SUMMARY OF THE INVENTION

It is an object of the present invention to provide a printing cylinder and an endless printing sleeve.

Another object of the present invention is to provide a magnetic printing cylinder and an endless printing sleeve.

A further object of the present invention is to provide a magnetic printing cylinder and an endless printing sleeve having a ferro-magnetic material.

Still another object of the present invention is to provide a magnetic printing cylinder and an endless printing sleeve in a web-fed rotary printing press.

Even a further object of the present invention is to provide a magnetic printing cylinder and an endless printing sleeve which has an inner circumferential length greater than an outer circumferential length of the magnetic printing cylinder.

Still yet another object of the present invention is to provide a magnetic printing cylinder and endless printing sleeve including a sleeve tightening assembly.

As will be discussed in greater detail in the description of the preferred embodiment, which is presented subsequently, the printing cylinder and endless sleeve in accordance with the present invention utilizes a magnetic printing cylinder as partial support for an endless loop printing sleeve. The sleeve may include a ferro-magnetic material and has an inner circumferential length which is greater than the outer circumferential length of the magnetic printing cylinder. A sleeve tightening assembly is utilized to support the sleeve as it is peeled off the printing cylinder. In one configuration, the sleeve tightening assembly may be portion of a cylindrical surface which carries a plurality of rollers that engage the inner surface of the endless printing sleeve. A sleeve tensioning assembly which uses a magnet or an electromagnet can be used with the sleeve tightening assembly. In another configuration, a linear motor can be used in conjunction with the sleeve tightening assembly to tension the endless sleeve.

In the printing cylinder and endless sleeve of the present invention, there is no pin and perforation alignment required to effect the driving of the endless printing sleeve or tape by the printing cylinder. The securement of the endless printing sleeve about a portion of the periphery of the magnetic printing cylinder is dependent on the use of the magnetic printing cylinder and the utilization of a ferro-magnetic material in the endless printing sleeve or tape. The magnetic force securely holds the endless printing sleeve in place and does away with the limitations of the perforated sleeve and the peripheral pins of the prior art device.

In the printing cylinder and endless sleeve of the present invention a large number of different formats can be printed without the need to remove and substitute the printing cylinder. When the format to be printed does not fit on the circumference of the sleeve carrier cylinder, the length of the endless printing sleeve can be varied in accordance with the size of the format to be printed. The use of the magnetic printing cylinder and the endless printing sleeve with a ferro-magnetic material, together with the utilization of a sleeve tightening assembly allows the printing cylinder and endless sleeve of the present invention to produce high quality prints in a register true manner.

It will thus be seen that the printing cylinder and endless sleeve of the present invention overcomes the limitations of the prior art. It provides a printing assembly that is a substantial advance in the art.

BRIEF DESCRIPTION OF THE DRAWINGS

While the novel features of the printing cylinder and endless sleeve in accordance with the present invention are set forth with particularity in the appended claims, a full and complete understanding of the invention may be had by referring to the detailed description of the preferred embodiments which are set forth subsequently, and as illustrated in the accompanying drawings, in which:

DESCRIPTION OF THE PREFERRED EMBODIMENTS

Figure 1:
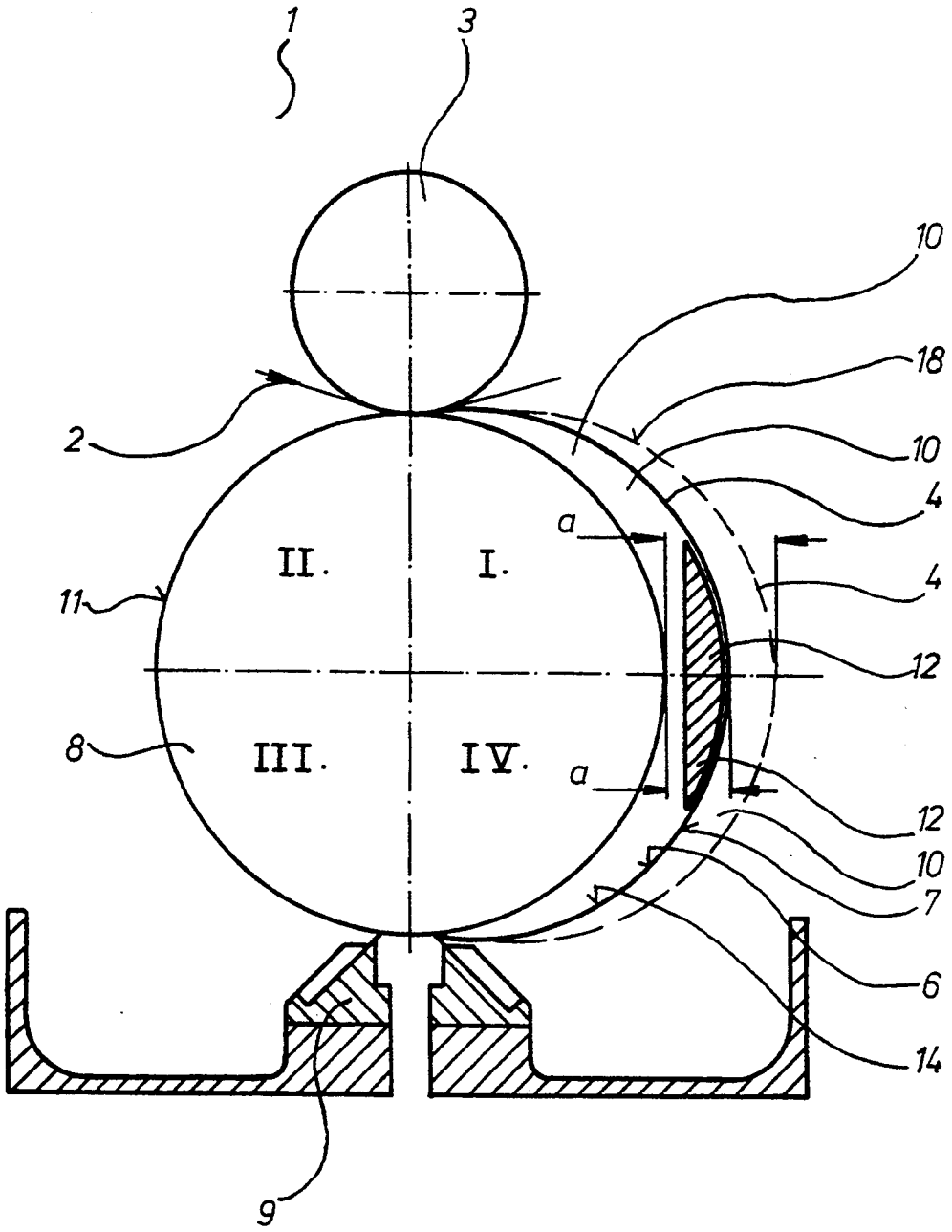
FIG. 1 is a schematic side elevation view of a printing unit in accordance with the present invention.

Referring initially to FIG. 1, there may be seen generally at 1 a printing unit, which may be a unit for accomplishing gravure printing, as well as possibly other types of printing, in accordance with the present invention. In this printing unit 1, a paper web 2 to be printed is caused to pass under pressure between a generally well-known pressure roller 3 and an engraved endless printing sleeve 4. This printing sleeve 4 carries the images to be printed on the paper web 2. The printing sleeve 4 has an inner surface 6 and an outer surface 7. The inner peripheral surface 6 of the endless printing sleeve 4 consists of a ferro-magnetic material, such as for example iron, nickel, or suitable alloys. This ferro-magnetic material is formed at least on the inner peripheral surface 6 of the endless printing sleeve 4. The outer layer 7 of the endless print sleeve 4 can be of another material which may or may not be ferro-magnetic. For example, the outer layer 7 of sleeve 4 can be an oleophilic copper, or of an ink transferring rubber at an indirect pressure.

The endless printing sleeve 4 can have an inner circumferential length which is just slightly shorter than an outer circumferential length of a printing sleeve carrier cylinder 8, such as a magnetic cylinder 8. This magnetic cylinder 8 can be provided with generally known compressed air openings which will assist in placing the endless printing sleeve 4 on, or in removing the sleeve 4 from the peripheral surface of the cylinder 8. These compressed air openings will be placed in the periphery of the cylinder 8. While the inner circumferential length of the printing sleeve 4 may be only a little shorter than the outer circumferential length of the magnetic printing cylinder 8, it can also be substantially greater than the outer circumferential length of the cylinder 8. This length of the endless printing sleeve depends on the printing format. As depicted in the dashed lines in FIG. 1, the inner circumferential length of the sleeve 4 can be, for example 30% greater than the circumferential length of the magnetic cylinder 8. This variability in the length of the sleeve 4 with respect to the cylinder 8 eliminates the dependence of the printing format on the circumferential length of the driven gravure printing forme cylinder.

In the printing cylinder and endless sleeve in accordance with the present invention, the magnetic cylinder 8, which supports and drives the endless printing sleeve 4, is driven through a fixed connection to the press drive at a speed such that its circumferential speed, and hence the circumferential speed of the endless sleeve 4 is the same, or the equivalent of the printing speed of the paper-web. Thus the printing speed of the paper web 2 is equivalent to the circumferential speed of the printing sleeve 4.

Referring again to FIG. 1, the magnetic cylinder 8 which supports and drives the endless printing sleeve 4 cooperates with a chambered doctor blade assembly 9. This doctor blade assembly 9 is positioned so as to apply printing ink to the outer surface 7 of the endless printing sleeve 4. As seen in FIG. 1, the chambered doctor blade 9 is situated so that it can cooperate with the magnetic printing cylinder 8 in either the third or the fourth quadrant of the cylinder 8, as determined by the running direction of the paper web 2, as indicated by the arrow on the web. The width of the chambered doctor blade 9 will be selected to be less than the width of the endless printing sleeve 4. This will insure that ink will not get onto the inner surface 6 of the sleeve 4. The printing sleeve 4 can also have a width that may be, for example $\frac{1}{4}$, $\frac{1}{2}$, $\frac{3}{4}$ or full width in relation to the maximum paper width. The sleeve 4 can also have another width, as determined by the format being printed.

The printing sleeve 4 is placed on the magnetic cylinder 8 and is held there by the magnetic cooperation between the magnetic printing cylinder 8 and the ferro-magnetic inner surface 6 of the endless printing sleeve 4. To accomplish the placement of the sleeve 4 onto the cylinder 8, the cylinder 8 can be removed from the printing unit as is known in the case of a gravure printing forme cylinder. The sleeve 4 is placed on the magnetic cylinder 8 and the sleeve and cylinder are then placed back in the printing unit 1 in proper register. In positioning the endless printing sleeve 4 on the magnetic printing cylinder 8, the sleeve 4 is placed in contact with the second and third quadrant of the cylinder 8. As may be seen in FIG. 1, since the peripheral length of the sleeve 4 may be greater than the peripheral length of the cylinder 8, a portion of the sleeve 4 in quadrants one and four of the cylinder 8 may not be close to the peripheral surface 11 of the magnetic printing cylinder 8 but may project away from cylinder peripheral surface 11 at a distance "a". Instead of possibly removing the cylinder 8 from the printing unit 1 to attach the printing sleeve 4, the printing sleeve 4 can be removed axially from the printing cylinder 8 by use of a tiltable bearing.

In accordance with the present invention, a sleeve tightening assembly is placed in an interspace area 10 that is formed between the periphery 11 of the magnetic cylinder 8 and that portion of the larger endless sleeve 4 which projects in a position at a distance "a" from the periphery 11 of the cylinder 8. The sleeve tightening assembly is a sleeve tightening device 12 which is securely attachable to a side frame of the printing unit 1. This tightening device or sleeve tightener 12 serves to support the sleeve 4 and to peel it off the periphery 11 of the magnetic printing cylinder 8 after the sleeve has run through the printing gap between the pressure cylinder 3 and the magnetic cylinder 8.

In accordance with the present invention, it is possible to provide the sleeve tightening assembly in either a sleeve contacting or non-contacting configuration. Thus the sleeve tightening assembly can either contact or not contact an inner side or inner peripheral surface 14 of the endless printing sleeve 4. As may be seen in FIG. 1, the sleeve tightening assembly 12 can be in the form of a tightening device having a circular segment shaped cross-section which may or may not engage the inner peripheral surface 14 of the sleeve 4. If the tightening device 12 contacts the inner surface 14 of the sleeve 4, it may have a smooth, low friction curved outer surface, as seen in FIG. 1, or may have a plurality of rollers 16 on the circular segment shaped outer surface 17. These rollers 16 may be supported for easy rotation and may be distributed over the entire width and along the length of the circular segment shaped part 17. Alternatively, one larger single roller could be utilized. Alternatively, there could be provided a sleeve tightening assembly 12 using compressed air jets that are positioned so as to blow compressed air between the free part of the printing sleeve 4 and the peripheral surface 11 of the magnetic cylinder 8.

Figure 3:
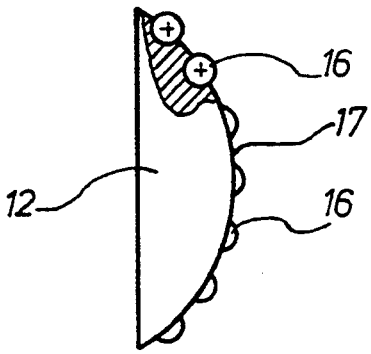
FIG. 3 is an enlarged side elevation view of a sleeve tightening assembly.
Figure 4:
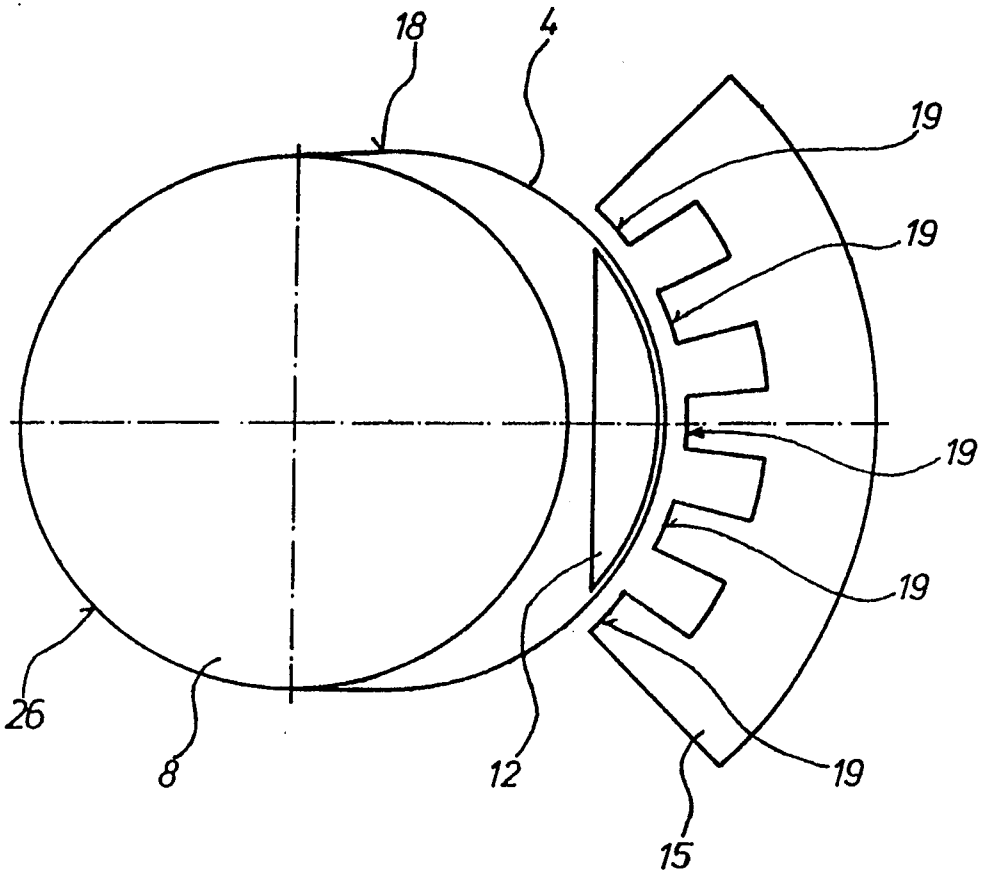
FIG. 4 is a side elevation view of a first sleeve tensioning assembly in accordance with the present invention.
Figure 5:
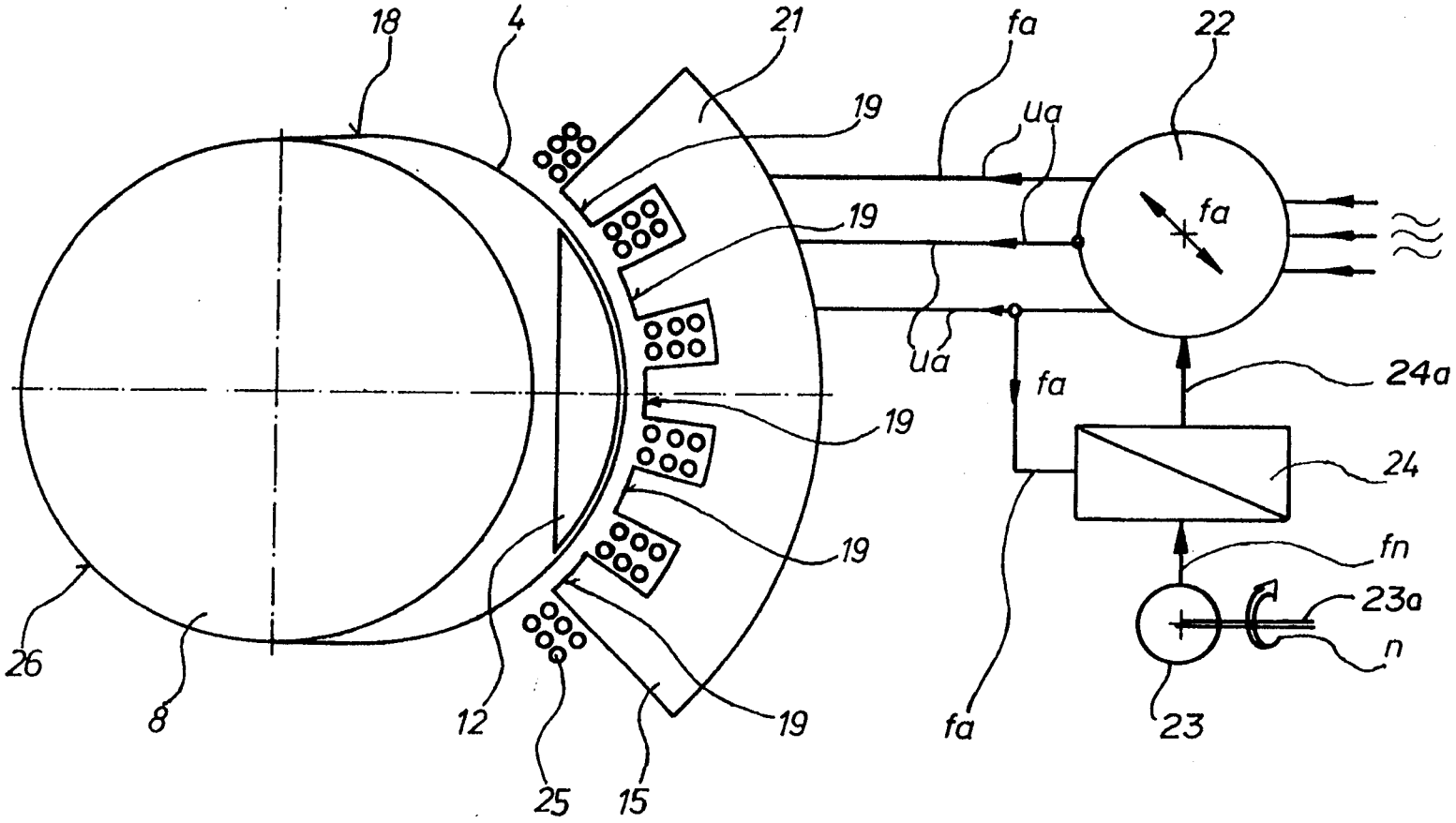
FIG. 5 is a side elevation view of a second sleeve tensioning assembly in accordance with the present invention.

Turning now primarily to FIGS. 4–5, there may be seen several alternative versions of a sleeve tensioning assembly in accordance with the present invention. These are non-contact sleeve tensioning assemblies which are usable with the sleeve tightening assembly 12 and which utilize magnetism and the magnetic inner layer 6 of the sleeve 4 to impart a tension to that portion of sleeve 4 which is not in physical contact with the magnetic printing cylinder 8. As is seen in FIG. 4, there can be provided a non-contact tightening assembly 15 which is secured to the printing press frame exteriorly of the endless sleeve 4 and which attracts the sleeve 4 by magnetic force. This tensioning assembly 15 is preferably located outside of the interspace 10, in contrast to the contact type of tensioning or tightening assembly shown at 12 in FIGS. 1 and 3. This non-contact tensioning assembly 15 effects the sleeve 4 over an outer side 18 of sleeve 4. The non-contact tensioning assembly 15 has a concave magnetic area 19 taken in the direction of the endless sleeve 4 with this concave area 19 being shaped to be adapted to a maximum admissible curvature of the free or unsupported portion of the printing sleeve 4.

In a first configuration shown in FIG. 4, the concave magnetic area 19 can have a number of strong permanent bar magnets which are arranged so that their poles end in the concave surface 19 of the non-contact tensioning assembly 15. In this connection, the magnetic north and south poles are, looked at over the width of the magnetic area 19, arranged at a distance adjacent each other.

Instead of the permanent bar magnets discussed above, the magnetic area 19 can be provided as electromagnets with limbs and cross arms or bars and yokes. In this instance, the ferro-magnetic part of the printing sleeve 4 forms the armature for the magnets and is arranged at a small distance from the limbs of the electromagnets. In the non-contact sleeve tensioning assembly 15 using either permanent magnets or electromagnets in the magnetic area 19, the free or unsupported portion of the endless sleeve 4 is drawn toward the non-contact sleeve tensioning assembly 15 without actually being in contact with it.

A second non-contacting sleeve tensioning assembly 15 is shown in FIG. 5. In this second non-contacting sleeve tensioning assembly 15 there is utilized a synchronous or asynchronous travelling field motor in the form of an asynchronous sector or linear motor 21. In this non-contact sleeve tensioning assembly 15 an inner radius of curvature of the linear motor 21 is adapted or configured to the outer curvature of the endless printing sleeve 4. This radius of curvature may also be adapted to the radius of curvature of the sleeve tightening assembly 12 that is located intermediate the magnetic cylinder 8 and the endless printing sleeve 4.

The sector or linear motor 21 is fed by a frequency-converter device 22, such as a static or dynamic three-phase current frequency converter. The frequency-converter device 22 generates a three-phase current having a frequency for which is proportional to the machine speed n. To achieve this, a frequency generator 23 generates an output frequency fn which is directly proportional to the rotational speed n of an input shaft **23*a* that rotates at the same speed as the magnetic cylinder 8. The output from the frequency generator 23 is fed to a regulator 24 which compares the desired frequency fn to the actual frequency fa generated by the frequency converter device 22, and supplies a corresponding electrical control output 24*a* to the frequency converter device 22. In this manner, the control output 24*a* insures that the output frequency of the frequency converter device 22 will remain proportional to the speed of the magnetic cylinder 8. The frequency converter device 22 provides a three-phase current output at frequency fa with a voltage Ua to a three-phase current coil 25 of the sector motor 21. This causes a magnetic force to be generated in the direction of rotation of the magnetic cylinder 8 according to the variable frequency fa which draws the printing sleeve 4 toward the sector motor 21. As a result, the printing sleeve 4 is tensioned thereby and neither touches the surface of the segment-tightener 12 nor the stator poles of the sector metor 21**.

Figure 2:
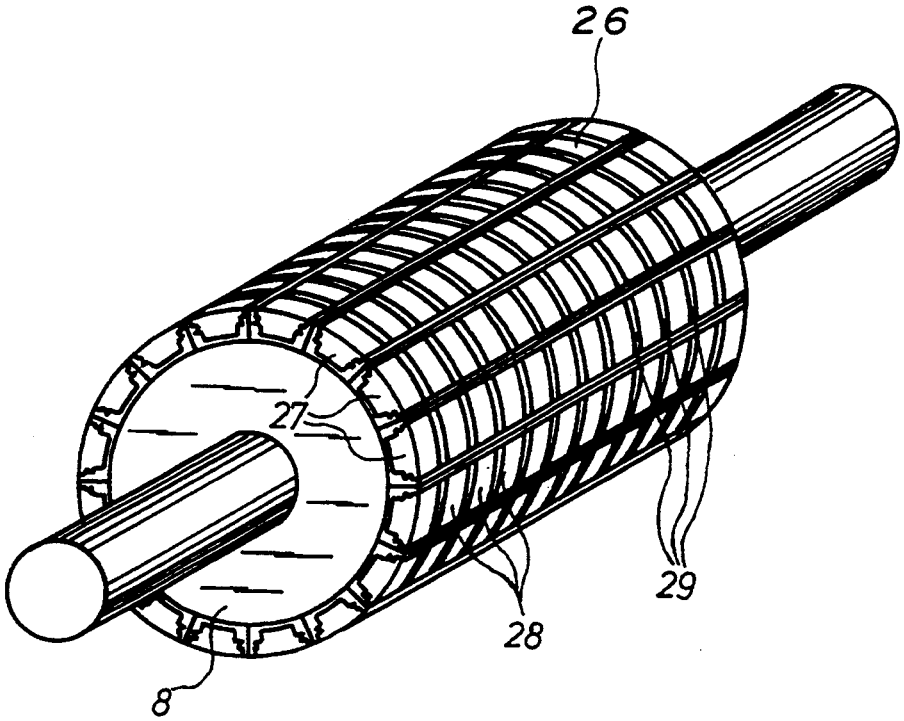
FIG. 2 is a perspective view of a magnetic printing cylinder of the present invention.

Turning now to FIG. 2, it will be seen that the magnetic printing cylinder 4 of the present invention utilizes a large number of permanent magnet pole devices 27 in a generally known manner, as disclosed in German document No. DE 22 31 452 A1 to form the magnetic device. These magnetic pole devices 27 generate a strong magnetic field over the entire outer surface of the circumference 26 of the magnetic printing cylinder 8. These magnetic pole devices 27 each consist of a permanent magnetic part 28 and of magnetic pole pieces 29. These permanent magnet parts 28 and magnetic pole pieces 29 are alternatingly arranged adjacent each other on the surface of the cylinder circumference 26.

While the printing cylinder and endless sleeve in accordance with the present invention has been discussed hereinabove for use in gravure printing, it will be understood that its use is not limited only to this type of printing. The outer layers of the ferro-magnetic endless printing sleeve 4 could, for example, consist of aluminum which could be capable of being used in offset printing. This aluminum layer could carry a light-sensitive coating and could thus be used as an offset printing plate. It is also within the scope of the present invention to vulcanize an offset blanket, that could be endless, onto the outer layer of the ferro-magnetic sleeve 4. Thus there could be executed a variable format offset printing plate or sleeve through the cooperation of the aluminum-coated and blanket printed ferro-magnetic sleeve 4.

While a preferred embodiment of a printing cylinder and endless sleeve in accordance with the present invention has been set forth fully and completely hereinabove, it will be apparent to one of skill in the art that a number of changes in, for example the overall size of the magnetic cylinder, the type of chambered doctor blade used, the bearings for support of the cylinder and the like could be made without departing from the true spirit and scope of the present invention which is accordingly to be limited only by the following claims.

What is claimed is:

1. A printing cylinder and endless printing sleeve assembly which is usable in a web-fed rotary printing press, said printing cylinder and endless printing sleeve assembly comprising:

a rotatable printing cylinder having a magnetic peripheral surface, said magnetic peripheral surface of said printing cylinder having a first peripheral length;

an endless printing sleeve supported on said printing cylinder and rotatable therewith, said endless printing sleeve having at least one layer of a ferro-magnetic material and further having an inner peripheral surface having a second length, said second length being greater than said first length; and means external to said printing cylinder to exert a tightening force on said endless printing sleeve.

2. The printing cylinder and endless printing sleeve assembly of claim 1 wherein said sleeve has an outer surface provided with printing characters.

3. The printing cylinder and endless printing sleeve assembly of claim 1 wherein said at least one layer of ferro-magnetic material is an inner layer of said sleeve.

4. The printing cylinder and endless printing sleeve assembly of claim 3 further wherein at outer layer of said sleeve consists of a non ferro-magnetic material.

5. The printing cylinder and endless printing sleeve assembly of claim 4 wherein said outer layer of said sleeve is an aluminum layer having a light sensitive layer.

6. The printing cylinder and endless printing sleeve assembly of claim 4 wherein said outer layer of said sleeve is an oleophilic blanket.

7. The printing cylinder and endless printing sleeve assembly of claim 1 wherein said sleeve tightening means is a circular segment shaped sheet metal member positioned intermediate said cylinder and said sleeve.

8. The printing cylinder and endless printing sleeve assembly of claim 7 wherein said sheet metal member has a face in engagement with said inner peripheral surface of said sleeve, said face carrying rotatable roller bodies.

9. The printing cylinder and endless printing sleeve assembly of claim 1 wherein said sleeve tightening means includes a concave body positioned adjacent an outer surface of said endless sleeve.

10. The printing cylinder and endless printing sleeve assembly of claim 9 wherein said concave body includes a linear motor.

11. The printing cylinder and endless printing sleeve assembly of claim 9 wherein said concave body carries permanent magnets.

12. The printing cylinder and endless printing sleeve assembly of claim 9 wherein said concave body carries electromagnets.

* * * * *